US009978252B2

(12) United States Patent
See et al.

(10) Patent No.: US 9,978,252 B2
(45) Date of Patent: May 22, 2018

(54) PERSONAL MONITORING AND EMERGENCY COMMUNICATIONS SYSTEM AND METHOD

(71) Applicants: Rosalie O. See, Lake Forest, CA (US); Wayne W. Spani, San Diego, CA (US)

(72) Inventors: Rosalie O. See, Lake Forest, CA (US); Wayne W. Spani, San Diego, CA (US)

( * ) Notice: Subject to any disclaimer, the term of this patent is extended or adjusted under 35 U.S.C. 154(b) by 0 days. days.

(21) Appl. No.: 15/396,398

(22) Filed: Dec. 30, 2016

(65) Prior Publication Data

US 2017/0116845 A1 Apr. 27, 2017

Related U.S. Application Data

(63) Continuation-in-part of application No. 14/499,087, filed on Sep. 27, 2014.

(51) Int. Cl.
*G08B 21/04* (2006.01)
*G08B 25/01* (2006.01)
*G08B 25/10* (2006.01)

(52) U.S. Cl.
CPC ..... *G08B 25/016* (2013.01); *G08B 21/0453* (2013.01); *G08B 25/10* (2013.01)

(58) Field of Classification Search
CPC ..... A61B 5/0022; A61B 5/0024; A61B 5/01; A61B 5/02; A61B 5/03; A61B 5/04; A61B 5/05; A61B 5/68; A61B 5/6801; A61B 5/6813; A61B 5/6824; A61B 2560/0431; G08B 21/0446; G08B 21/04153; G08B 25/001; G08B 25/014; G08B 25/016; G08B 25/08; G08B 25/10
See application file for complete search history.

(56) References Cited

U.S. PATENT DOCUMENTS 8,180,440 B2 * 5/2012 McCombie ..... A61B 5/0205 600/513
2004/0130446 A1 * 7/2004 Chen ..... G08B 25/016 340/539.12
2006/0152373 A1 * 7/2006 King ..... A61B 5/024 340/573.1

(Continued)

*Primary Examiner* — Van Trieu
(74) *Attorney, Agent, or Firm* — John S. Christopher

(57) ABSTRACT

A personal monitoring and emergency communications system including a mobile wrist worn apparatus carried by a monitored person for minimizing emergency response time notwithstanding the monitored person's conscious state and including an array of sensors for periodically sensing vital biometric parameters of the monitored person, a memory for storing and comparing the sensed parameters to a pre-stored standard range of the vital parameters for providing a comparator signal, an alarm circuit for evaluating the comparator signal for providing an emergency alarm signal when the sensed vital parameters are not within the pre-stored standard range, and a programmable logic controller for automatically responding to an emergency including broadcasting the alarm signal from a signal transceiver to a worldwide communication network via either of a pair of parallel communication links for locating and continuously communicating the monitored person's data directly to the closest medical response team for providing emergency medical services.

15 Claims, 6 Drawing Sheets

(56) References Cited

U.S. PATENT DOCUMENTS

| | | | | |
|---|---|---|---|---|
| 2008/0004904 | A1* | 1/2008 | Tran | A61B 5/0006 705/2 |
| 2009/0105558 | A1* | 4/2009 | Riley-Doucet | A61B 5/486 600/301 |
| 2009/0322513 | A1* | 12/2009 | Hwang | A61B 5/02055 340/539.12 |
| 2011/0004072 | A1* | 1/2011 | Fletcher | A61B 5/0002 600/300 |
| 2011/0066009 | A1* | 3/2011 | Moon | A61B 5/0002 600/301 |
| 2011/0066010 | A1* | 3/2011 | Moon | A61B 5/0205 600/301 |
| 2015/0279187 | A1* | 10/2015 | Kranz | G08B 21/0415 340/539.12 |
| 2017/0150893 | A1* | 6/2017 | McCombie | A61B 5/0205 |

* cited by examiner

PERSONAL MONITORING AND EMERGENCY COMMUNICATIONS SYSTEM AND METHOD

This patent application is being filed as a non-provisional patent application under 35 USC Section 111(a) and is a Continuation-in-Part of the patent application having Ser. No. 14/499,087 filed on Sep. 27, 2014.

BACKGROUND OF THE INVENTION

Technical Field

The present invention relates to an emergency communications system. More specifically, the present invention relates to methods and apparatus for a personal monitoring and emergency communications system and method for facilitating the prompt locating, diagnosing and initial treating of monitored patients in medical emergencies where a typical monitored patient is for example, physically injured, mentally impaired and lost, underage and lost, or a civil servant performing her duties.

Background Art

Medical emergencies occur on a regular basis. Of primary significance to the full recovery of a patient in many of these emergencies is obtaining prompt medical attention. Consequently, in the event of a medical emergency, the response time in locating, diagnosing and initially treating the patient may be critical. Quicker response times typically results in preventing long term disabilities and even death. As a result, any system designed to reduce the initial response time in locating, diagnosing and initially treating the patient is significant.

Devices intended to assist injured persons, the elderly, and infants have been known in the past. Such devices have been available to the public in various embodiments including wall mounted monitoring devices, pendants worn by the patient or attached to the patient's clothing, and even wrist worn devices. Typically, these devices are either electrically hard wired (as with a wall mounted unit for monitoring an infant from an adjacent room), or are battery operated. The prior art devices worn on the person typically are in signal communication with a monitoring service and include an emergency communication button or panic button which can be depressed by a patient in the case of an emergency situation (e.g., for example, a fall by an elderly patient) if the patient is conscious. In some cases, the communication link can accommodate audio voice frequencies which enables the monitoring personnel to verbally communicate with the patient after the patient has actuated the emergency communication button. The monitoring service usually can identify the patient by identifying the communication circuit that is actuated when the patient depresses the emergency communication button. That way, the monitoring service can dispatch medical response personnel to the site of the injured patient.

Consequently, it is believed that many of the prior art designs are limited to signal and/or verbal communications between the monitoring service and the monitored patient. It should be understood that many patients now suffer from mental disability in addition to physical impairment. Such mental disability or impairment may manifest itself in the form of memory loss as is associated with Alzheimer's Disease. Thus, the monitored patient may not be able to provide useful information to the monitoring service as to the patient's physical condition and location at the time of the emergency. This situation further complicates the desired objective of providing prompt locating, diagnosing and initial treating of the monitored patient who is the victim of a medical emergency.

Prior art patents and publications directed to emergency communications systems will now be mentioned that may be relevant to the personal monitoring and emergency communications system and method of the present invention.

In U.S. Patent Publication No. US 2015/0279187 filed by Kranz on Aug. 18, 2011 and published on Oct. 1, 2015 there is disclosed an invention which describes a set of units able to communicate one with each other by means of cooperating software, mutually control themselves and imagine displays from other units. The invention enables by means of an indicated set or individual units as well, to make remote monitoring of persons and control their location, health condition and capacity. Also, it enables the monitored persons to check their condition on a mobile unit. The objective of the invention according to Kranz is to create a personal emergency alarm device where the monitored person could prevent false alarms from being set off, particularly when monitoring the movement of persons where in the event there is no movement and the person is not in danger, the delay could be preset by the monitored person. Second, to allow monitoring of normal reaction with the option of preventing the alarm and setting the alarm delay by the monitored person. Third, to create a device that would allow monitoring and communication on the entire monitored premises without having to set up phones and sensors in all rooms.

In U.S. Patent Publication No. US 2004/0130446 filed by Chen et al on Jan. 6, 2003 and published on Jul. 8, 2004 there is disclosed a wireless communication and global location enabled intelligent health monitoring system comprising a plurality of wireless medical sensor apparatus 300 for measuring a patient's vital signs on different parts of a patient's body, and a main processing unit apparatus 100 containing system software 500 that uses an active, real-time monitoring method to process a patient's vital signs and location information for providing an alert on location and transmitting an emergency request to a remote patient monitoring station for immediate assistance. Under an urgent situation, the two-way wireless communication, global position data and adaptive location assessment capabilities allow an emergency service vehicle to be dispatched to the patient that carries the system. The system also includes an HTTP web server that can respond to a remote request sent wirelessly either from a patient monitoring station or a patient's family member through a standard Internet browser, anywhere and anytime.

In U.S. Pat. No. 7,299,034 issued to Kates on Nov. 20, 2007 there is disclosed a system for wearable electronics devices configured to intercommunicate through wireless communication and, optionally, to communicate with other electronic devices such as cellular telephones, computers, computer networks, and the like. In one embodiment, a communication module receives information from one or more devices and provides audio and, optionally, stimulatory information to the wearer. In another embodiment, an electronic device is provided in a shoe. In yet another embodiment, a wireless (or wired) earpiece is provided to provide audio information to the user. In yet another embodiment, the shoe-mounted device includes a display to show time, caller-id information, temperature, pulse rate and the like.

In U.S. Pat. No. 7,312,709 issued to Kingston on Dec. 25, 2007 there is disclosed an alarm system including an alarm signaling device having a transceiver for transmitting an alarm signal. The system includes a responder device for receiving the alarm signal, the responder device having a device for signaling an alarm. The alarm signaling device includes an interface for receiving user information and an activating device for activating the transceiver to transmit the alarm signal in response to the user information. The transceiver device further includes a device for receiving a response signal from the responder device.

In U.S. Pat. No. 5,742,233 issued to Hoffman et al. on Apr. 21, 1998 there is disclosed a personal security and tracking system. A signaling system comprises a portable signaling unit, a remote alarm switch device, a central dispatch station, and a wireless communication system such as a cellular or telephone system, and a GPS or alike system. The portable signaling unit and the remote alarm switch may be adapted to be worn at different locations on the person's body. The remote alarm switch may be concealed in the form of a wristband or in the form of any other object such as a broach, pendent, or keychain. When the person in distress activates the remote alarm switch or when the remote alarm switch is removed from the individual by a forceful or unauthorized action or when the signaling unit is removed from the proximity of the remote alarm switch, the portable signaling unit sends a data transmission which includes its location to the central dispatch station.

The portable signaling unit also has manual alarm triggering capabilities so it can be used without the remote alarm switch unit. The central dispatch station receives the data transmission and accurately displays the user identification, stored personal information, nature of the alarm; in addition the location of the portable signaling unit is superimposed on a digitized map at a position corresponding to the location of the person wearing the portable signaling unit. The portable signaling unit can be remotely activated from a central dispatch station to determine and monitor the location of the portable signaling unit.

In U.S. Pat. No. 7,417,537 issued to Lee on Aug. 26, 2008 there is disclosed a military wireless communication terminal which includes a global positioning system receiver outputting location information of the terminal, a terrestrial magnetism sensor for sensing azimuth of the terminal, a memory in which map information of an operating area is stored, a location transmitting unit for periodically transmitting terminal location information output from the global positioning system receiver, a radio communication unit for transmitting and receiving signals from a designated originating place, a military force location information processing unit for generating military force location information, an absolute azimuth calculator for correcting sensed azimuth by the terrestrial magnetism sensor and outputting azimuth information, a map information reading unit for reading map information, a location information overlaying unit for overlaying the azimuth information, the military force to location information on the read map information, and a display for showing the read map information with the azimuth information and military force information overlaid.

In U.S. Pat. No. 8,423,000 issued to Dhuna on Apr. 16, 2013 there is disclosed a guardian system for cognitively-impaired individuals. The system includes a wrist phone system having a display, a global positioning system, and a SIM card. The wrist phone system is tethered to a PDA phone so that the PDA phone can be utilized to input information into the wrist phone system. In addition, the PDA phone and the wrist phone system can communicate with one another and with monitoring devices such that if a warning or emergency condition is provided by the individual or by a monitor, a warning message can be sent to a care giver to address the emergency.

In U.S. Patent Publication No. US 2013/0328678 directed to Shechter et al. and published on Dec. 12, 2013 there is disclosed a new and improved electronic monitoring home units and associated installation methods. The present disclosure provides for an electronic monitoring home unit capable of automated confirmation of location and method of automated confirmation of location when a home unit has been installed. The present disclosure provides for a home unit capable of intelligent inclusion zone setting for a home unit and a method of such inclusion zone setting. The present disclosure also provides for a streamlined installation method with automated communication between a home unit and a central monitoring system.

In U.S. Patent Publication No. US 2007/0182548 directed to Raad and published on Aug. 9, 2007 discloses an apparatus for providing information regarding a missing person to a monitoring station. The apparatus and system for locating a person includes a G.P.S. cellular watch removably secured to the person, which acts as a mobile transmitter. When panic buttons on the watch are depressed simultaneously, a location signal is emitted by the watch so that a remote Emergency Control Center (ECC) is informed of the person's location, the panic buttons also automatically starting a photo/video recorder, images from which can be viewed in the Emergency Control Center (ECC), as well as an audio microphone, which allows the ECC to listen, record and save all sounds received by the microphone. The watch face also comprises a security code pad, with a corresponding key pad entry also unique to that apparatus, to lock or unlock the band from the user's wrist, without which entry the apparatus cannot be removed from the person.

Thus, there is a need in the art for a personal monitoring and emergency communications system and method comprising a programmable logic controller that reduces the response time in locating, diagnosing and initially treating a monitored person in an emergency situation by transmitting with dispatch proprietary data including global positioning system location coordinates and current time, date and vital medical measurements directly from an array of sensors and a medical history all located on a mobile wrist worn apparatus carried by the monitored person via an appropriate communication link including a worldwide communication network and directed primarily to a paramedic medical response team located closest to the monitored person where the medical response team is identified, located and communicated with by the programmable logic controller.

DISCLOSURE OF THE INVENTION

Briefly, and in general terms, the present invention provides a new and improved personal monitoring and emergency communications system and method for use in an emergency that enables the prompt locating, diagnosing and initial treating of a monitored person during exigent circumstances. Such a situation may present itself during an emergency in which the monitored person is physically injured, mentally impaired and lost, underage and lost, or even a civil servant injured during the course of performing her duties.

The present invention is embodied in a personal monitoring and emergency communications system that includes a plurality of sensor devices, measuring components, a transceiver (transmitter/receiver), and a programmable logic controller (PLC) integrated into a wrist worn apparatus similar in appearance to a time piece worn on the wrist of the monitored person. In the event of an emergency situation, a preferred embodiment of the present invention will automatically transmit with dispatch proprietary data of the monitored person to a medical response team closest to the monitored person via an appropriate communication link. The present invention will facilitate a quicker response time so that the monitored person will receive the appropriate medical attention in the minimum time resulting in a higher probability of survival and recovery. Examples of medical emergencies for which the present invention is useful include heart attack, diabetic emergency, seizures, blood pressure conditions, falls resulting in damaged or broken limbs, lost or displaced young and elderly persons, and persons with mental impairment to name a few.

Quicker response times result from the use of the personal monitoring and emergency communications system and method because the present invention incorporates sensor devices employed for measuring the vital parameters of the monitored person. Examples of these measured vital parameters or biometric data include current body temperature, pulse rate, and blood pressure. Furthermore, the personal monitoring and emergency communications system also transmits the current date and time of the periodic measurement of the vital parameters of the monitored person. This important information including patient identifying information encoded within the mobile wrist worn apparatus can then be automatically transmitted to a medical response team closest to the monitored person via the suitable communication link such as an existing cell phone tower or an existing global positioning system (GPS) satellite and a worldwide communication network. With this transmitted information from the mobile wrist worn apparatus, the location and the general physical condition of the monitored person can be promptly determined which facilitates a quicker response time in locating, diagnosing and treating the monitored person in an emergency situation. Further, this emergency transmission can occur whether the monitored person is conscious and capable of operating the mobile wrist worn apparatus or, in the alternative, is unconscious due to a fall and resulting body and/or head trauma.

The combination of components of the present invention provide the inventive features of sensing, measuring, storing, and comparing the measured human vital biometric parameters, then actuating an alarm mode and the programmable logic controller (PLC), and then automatically transmitting these measured parameters via a ti suitable communication link and worldwide communication network to the closest medical response team identified and communicated with by the programmable logic controller to expedite emergency medical services to the monitored person. In general, the fundamental features of the personal monitoring and emergency communications system and method of the present invention include the following. The bottom interior portion of a wrist band of the mobile apparatus worn by the monitored person is positioned over the blood vessels in the human wrist and includes the sensors at this location for measuring the pulse rate and the body temperature. These vital parameters are transmitted via conductors in the wrist band to the circuitry located on the top of the mobile wrist worn apparatus of the personal monitoring system. These vital biometric parameters are periodically measured and stored in memory and compared to a normal standard range for these parameters in the personal monitoring system. These vital parameters are also utilized to measure the blood pressure of the monitored person by sensing the systolic and diastolic measurements in the blood vessels in the human wrist as is known in the relevant art.

The memory storage component of the mobile wrist worn apparatus of the personal monitoring system also includes personal and medical history data associated with the monitored person stored therein. All of this information is provided in any uploading transmission to the closest medical response team along with the date, time, and most current vital parameter readings resident in the storage memory. Once the mobile wrist worn apparatus is programmed with the relevant data, it is positioned on the wrist of the monitored person. During an emergency situation, the programmable logic controller automatically initiates the broadcasting of the emergency alarm signal and data package from a signal transceiver located within the mobile wrist worn apparatus to a worldwide communication network (e.g., Internet) via one of a pair of parallel communication links for continuously communicating the exact time, date, GPS location coordinates, the vital biometric parameters, and medical history to the closest medical response team. The wrist worn apparatus is a mobile unit and is powered by an appropriate battery source which can be connected to the appropriate circuitry therein by several methods including (a) a pressure activated switch located behind an outer casing of the wrist worn apparatus or, in the alternative, (b) a body temperature switch similarly positioned behind the outer casing of the wrist worn apparatus. If the updated vital parameter readings do not fall within the normal standard range for these parameters resident in the storage memory, the mobile wrist worn apparatus generates a signal for activating an alarm circuit which includes both visual and audible alarms. A false alarm signal can be reset by an acknowledgment button which can also be used to enter various codes into the wrist worn apparatus to accomplish various functions.

In an actual emergency, the acknowledgment button is not depressed and the personal monitoring and emergency communications system will enter the broadcast mode. The broadcast mode is designed to utilize the facilities of an existing Global Positioning System (GPS) satellite or, in the alternative, the facilities of an existing cell phone repeater tower or station. The broadcast mode is facilitated by a signal transceiver incorporated into the wrist worn apparatus. The alarm mode signal is forwarded to the signal transceiver which generates a transmission signal having suitable wave propagation characteristics which is broadcast from an antenna positioned on the wrist worn apparatus. The transmission signal is then intercepted by the receiver circuit of (a) the nearest cell phone tower repeater station or (b) by a GPS satellite station. The signal transceiver encodes all of the information of the monitored person and transmits it directly to the closest medical response team. Upon receiving the transmitted information, the cell phone tower processes the encoded signals and forwards the processed signals to the closest medical response team via a worldwide communication network. In the alternative, the intelligence information received by the GPS communications satellite located in a stationary orbit is processed and directed to the worldwide communication network, for example, the Internet, which is directly connected to the medical response team closest to the monitored person.

Upon receipt of the processed information by the medical response team closest to the monitored person, the transmitted data associated with the monitored person can be utilized to assist the medical response team to provide emergency care. Upon reaching the monitored person, the paramedic response team can then deliver emergency medical services to and arrange for the transfer of the monitored person to an appropriate medical facility. Further, the medical facility will also have been notified of the arriving monitored person. In this manner, the monitored person suffering from the injury or impairment receives the needed medical care with the minimum of time delay which is a significant feature of the present invention.

The present invention is generally directed to a personal monitoring and emergency communications system and method for use in an emergency that enables the prompt locating, diagnosing and initial treating of a monitored person during exigent circumstances such as during physical injury or mental impairment. The present invention includes a mobile wrist worn apparatus carried by a monitored person for minimizing emergency response time notwithstanding the conscious state of the monitored person and including an array of sensors for periodically sensing vital biometric parameters of the monitored person, a memory for storing and comparing the sensed parameters to a pre-stored standard range of the vital parameters for providing a comparator signal, an alarm circuit for evaluating the comparator signal for providing an emergency alarm signal when the sensed vital parameters are not within the pre-stored standard range, and a programmable logic controller (PLC) for automatically responding to an emergency including broadcasting the alarm signal from a signal transceiver to a worldwide communication network via either of a pair of parallel communication links for locating and continuously communicating the monitored person's data including the exact time, determined location coordinates, and the vital parameters and a medical history directly to the closest medical response team for providing emergency medical services while minimizing response time.

These and other objects and advantages of the present invention will become apparent from the following more detailed description, taken in conjunction with the accompanying drawings which illustrate the invention, by way of example.

DETAILED DESCRIPTION OF THE INVENTION

The present invention relates to a personal monitoring and emergency communications system and method 100 as shown in FIGS. 1-5 (hereinafter referred to as the personal monitoring system 100). The personal monitoring system 100 is intended for use in an emergency and enables the prompt locating, diagnosing and initial treating of a monitored person (not shown) during exigent circumstances such as in the case of physical injury or mental impairment, the elderly or underage being lost, or even a civil servant injured during the course of performing her duties.

Figure 1:
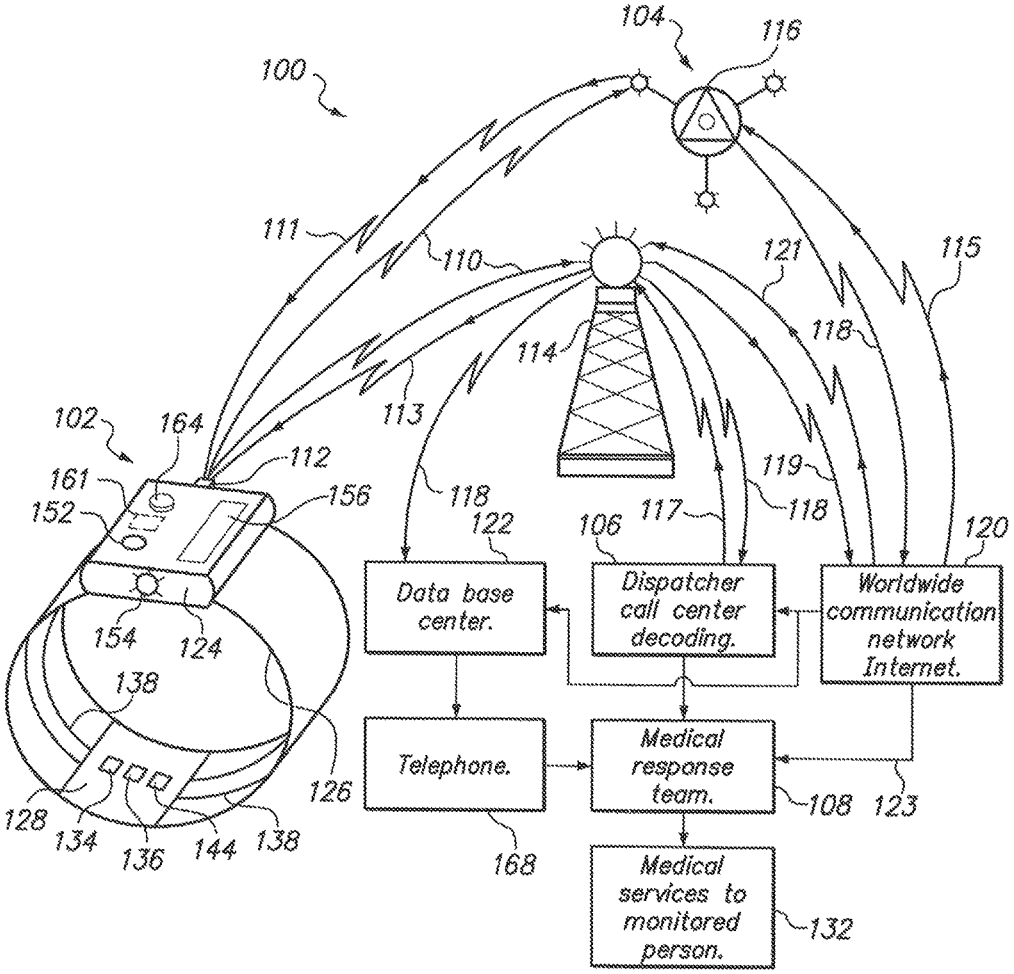
FIG. 1 is an illustration of the present invention partly in prospective and partly as a block diagram of a personal monitoring and emergency communications system and method showing a mobile wrist worn apparatus exhibiting various features and that identifies and communicates directly with a medical response team closest to a monitored person during an emergency via suitable parallel communicate links such as an existing cell phone tower or an existing global positioning system (GPS) satellite and a worldwide communication network such as the Internet.

In a preferred embodiment of the present invention as shown in FIGS. 1-5, the personal monitoring system 100 includes a mobile wrist worn apparatus 102 worn about the wrist of the monitored person (not shown) which functions in combination with and communicates with one of a plurality of known communication links 104. In turn, the specific communication link 104 further communicates directly with the closest medical response team 108 via a worldwide communication network 120 which is utilized for the prompt locating, diagnosing and initial treatment of the monitored person (not shown) during an emergency. Further, the communication links 104 communicate with a secondary ground based emergency dispatcher call center 106 as a back-up means of contacting the closest medical response team 108. It is important to understand that the communication links 104 directly contact the closest medical response team 108 via the worldwide communication network 120 to minimize any possible time delay in dispatching medical services to the monitored person. It is emphasized that a transmission signal 110 is broadcast from an antenna 112 of the wrist worn apparatus 102 which is then intercepted by a receiver circuit of a cellular telephone (cell phone) tower repeater station 114 or, in the alternative, by a receiver circuit of a Global Positioning System (GPS) satellite station 116 as shown in FIG. 1. Further, it is noted that either the cell phone tower repeater station 114 or the GPS satellite station 116 (which ever receives the transmission signal 110) forwards the transmission signal 110 after amplification and signal processing as a re-transmission signal 118 directly to the closest local medical response team 108 via the worldwide communication network 120. This action is accomplished by directing the re-transmission signal 118 primarily to {a} the worldwide communication network 120 such as, for example, the Internet, then secondarily to {b} the dispatcher call center 106, and to {c} a date base center 122 as is shown in FIG. 1. This redundant design is intended to provide backup support structure so that the closest local medical response team 108 is always aware of and receives the broadcast containing the personal data regarding the emergency condition involving the monitored person.

At this point, we shall review FIGS. 1, 2, 4A and 4B to briefly discuss the reciprocal nature of the communication links between the main components of the personal monitoring system 100. As a general rule, all main components have a transmission link and a receiving link with all other main components with one exception {which is the data base center 122}. That is, each main component has the capability of both transmitting a signal to and also receiving a signal from every other main component in the personal monitoring system 100. We will review the communication links in FIG. 1 and then call attention to those corresponding communication links in FIGS. 2, 4A and 4B.

Figure 2:
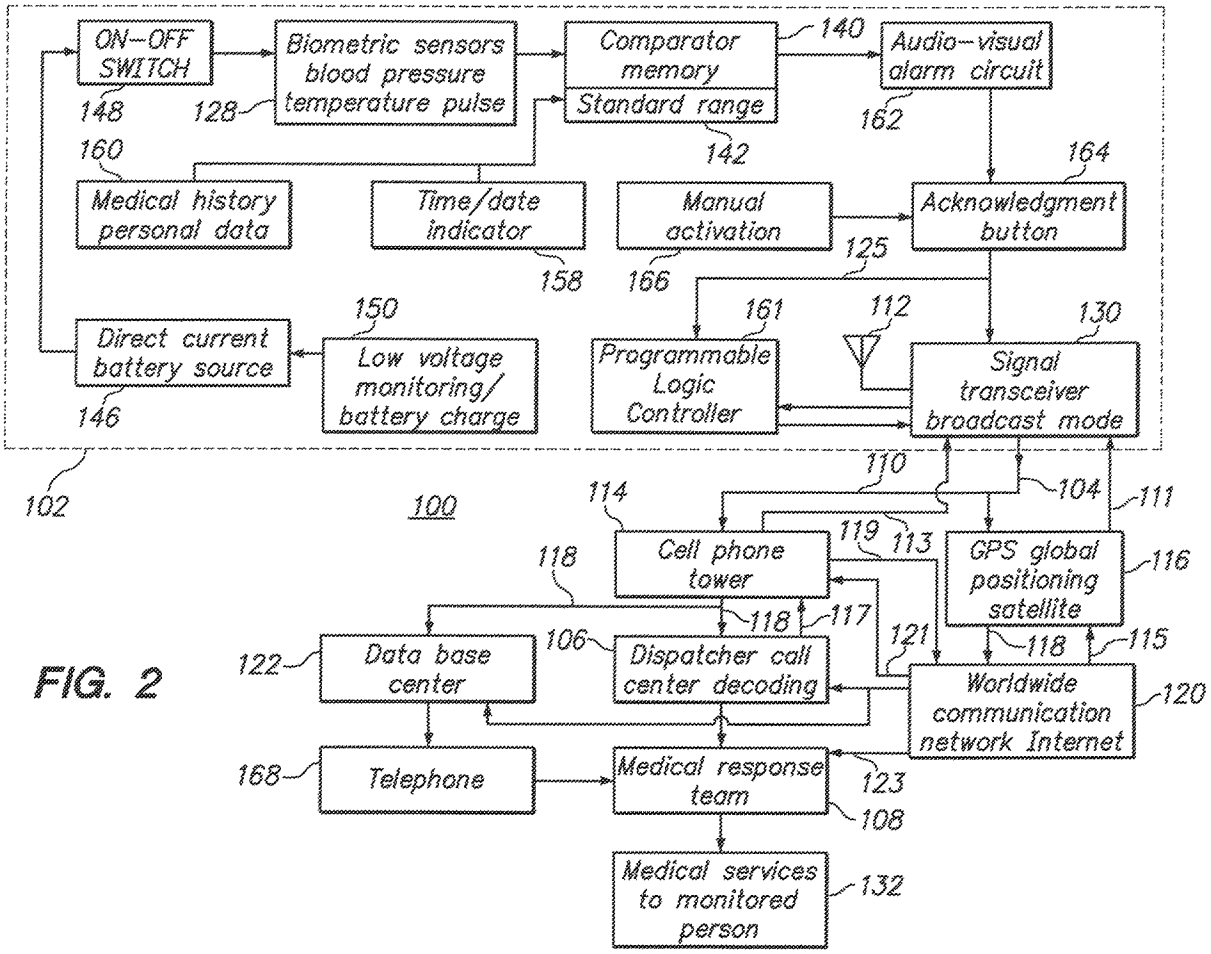
FIG. 2 is a block diagram of the personal monitoring and emergency communications system and method of FIG. 1 showing the components for sensing, measuring, storing, and comparing human vital parameters, actuating an alarm mode, and transmitting the abnormal measured parameters under the direct control of a programmable logic controller via parallel suitable communication links and the Internet directly to the closest medical response team to expedite emergency medical services to a monitored person during an emergency.

We begin with the antenna 112 shown extending outward from an outer casing 124 of the mobile wrist worn apparatus 102 in FIG. 1. It is noted that each of the main components has the capability of responding to a received signal that was transmitted by another main component. Initially, a signal transceiver 130 broadcasts the transmission signal 110 to both the cell phone tower repeater station 114 and the global positioning system (GPS) satellite 116 as shown in FIG. 1. Each response signal is distinguished by an identifying number. For example, the transmission signal 110 is transmitted to the GPS satellite 116 and a return signal 111 is transmitted from the GPS satellite 116 back to the antenna 112 of the transceiver 130 shown in FIG. 2. This communication link is also shown in FIG. 2 between the signal transceiver 130 {broadcast mode} and the GPS global positioning satellite 116. The transmission signal 110 is also transmitted to the cell phone tower repeater station 114 and a return signal 113 is transmitted from the cell phone tower repeater station 114 back to the antenna 112 of the transceiver 130. This communication link is also shown in FIG. 2 between the signal transceiver 130 {broadcast mode} and the cell phone tower 114. Likewise, the re-transmission signal 118 is transmitted between the GPS satellite 116 and the worldwide communication network 120 and a return signal 115 transmitted from the worldwide communication network 120 back to the GPS satellite 116. This communication link is also shown in FIG. 2 between the GPS satellite 116 and the worldwide communication network 120.

Next, the cell phone tower repeater station 114 communicates with both the dispatcher call center 106 and the worldwide communication network 102. Firstly, the re-transmission signal 118 is transmitted from the cell phone tower 114 to the dispatcher call center 106 and a return signal 117 is transmitted from the dispatcher call center 106 back to the cell phone tower 114. This communication link is also shown in FIG. 2 between the cell phone tower 114 and the dispatcher call center 106. Secondly, a retransmission signal 119 is transmitted from the cell phone tower 114 to the worldwide communication network 120 and a return signal 121 is transmitted from the worldwide communication network 120 back to the cell phone tower 114. This communication link is also shown in FIG. 2 between the cell phone tower 114 and the worldwide communication network 120. Finally, it is shown in FIGS. 1 and 2 that the re-transmission signal 118 is also transmitted from the cell phone tower 114 to a data base center 122.

Figure 3:
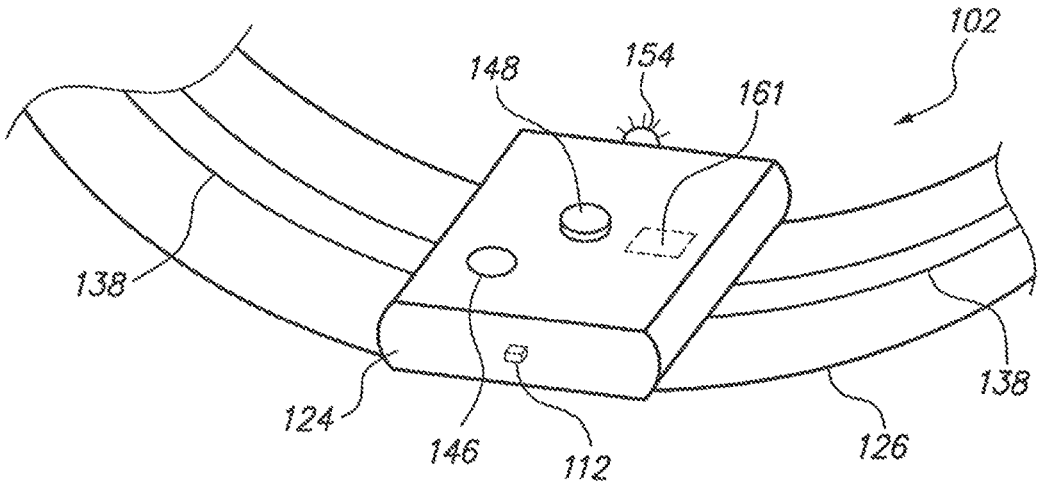
FIG. 3 is a prospective view of a spring-loaded, electrical actuation switch for energizing the personal monitoring and emergency communications system of FIG. 1 showing the switch located on the rear side of the mobile wrist worn apparatus where it would physically contact the wrist of the monitored person.

We shall now direct our attention to the structural combination of the mobile wrist worn apparatus 102 as shown in FIGS. 1-3. It is the mobile wrist worn apparatus 102 of the personal monitoring system 100 carried on the wrist of the monitored person (not shown) which provides continuously updated biometric data that is utilized for evaluating the condition of the monitored person. It is the updated biometric data that activates the personal monitoring system 100 (whether the monitored person is conscious or unconscious) which then communicates directly with the closest local medical response team 108 via one of the known communication links 104 and the worldwide communication network 120. The personal monitoring system 100 also communicates with the dispatcher call center 106 as a secondary back-up means for ensuring delivery of the broadcast of the personal data of the monitored person to the closest medical response team 108. As shown in FIG. 1, the wrist worn apparatus 102 is formed having the outer casing 124 with an attached wrist band 126 which is similar in appearance to a standard time piece or wrist watch. The attached wrist band 126 can be loose fitting. However, in the preferred embodiment of the present invention, the attached wrist band 126 is intended to exhibit a snug fit about the wrist of the monitored person. Such a snug fit of the wrist band 126 about the wrist of the monitored person facilitates the detection of the biometric data which is key to the automatic operation of the personal monitoring and emergency communications system 100.

The outer casing 124 can be, for example, rectangular in shape forming a three-dimensional parallelepiped and which houses a plurality of components designed to sense the current biometric data of the monitored person. The current biometric data is collected in the form of a plurality of vital parameters which include but are not limited to the human pulse rate, body temperature and blood pressure. Furthermore, the personal monitoring system 100 also transmits the current time and date of the periodic measurement of the vital parameters of the monitored person as shown in FIGS. 1 and 2. These vital parameters are then measured and compared to a pre-stored standard range of vital parameters to determine if an abnormal condition exists for generating an emergency alarm signal. The present invention includes a plurality of sensor devices 128, measuring components and the transceiver (signal transmitter/receiver) 130 with a global positioning unit (GPS) integrated into the wrist worn apparatus 102 which is worn on the wrist of the monitored person similar to, for example, a wrist watch. In case of an emergency, the invention will transmit with dispatch, either through manual operation or through automatic operation, the proprietary data including identifying information of the monitored person and address which are encoded within the wrist worn apparatus 102 directly to the closest medical response team 108 for action {and also to the dispatcher call center 106 as a back-up means of contacting the closest medical response team 108} via the appropriate communication link 104 and the worldwide communication network 120. With this information, the location and general physical condition of the monitored person can be determined with the minimum of delay. Consequently, the present invention will facilitate a quicker response time in locating, diagnosing and treating the monitored person who will then receive the appropriate emergency medical services 132 consistent with the condition of the existing emergency in the minimum amount of time. Because the design of the present invention minimizes the response time, the probability of survival and recovery of the monitored person is higher. Further, this emergency transmission can occur whether the monitored person is conscious and capable of operating the wrist worn apparatus 102 or, in the alternative, is unconscious due to a fall and resulting body and/or head trauma.

The combination of components that comprise the personal monitoring system 100 provide the inventive combination of features including sensing, measuring, storing and comparing of the sensed human vital parameters or biometric data prior to actuating the alarm mode and transmitting these sensed parameters via the communication link 104 and the worldwide communication network 120 directly to the closest local medical response team 108 for action {and also to the dispatcher call center 106 as a back-up means of contacting the closest medical response team 108}. The vital parameters are sensed in the following manner. As can be seen in the accompanying FIG. 1, the bottom interior portion of the wrist band 126 attached to the outer casing 124 of the wrist worn apparatus 102 will be positioned over the blood vessels of the wrist of the monitored person. The pulse rate of the monitored person can be measured at this location. Consequently, the plurality of sensors 128 employed for sensing and measuring the vital parameters of pulse rate and body temperature are positioned at this location on the wrist band 126. Of course, as is known in the art, the parameter of body temperature is measured by a suitable thermometer device 134 and the parameter of pulse rate is sensed and measured by a known impulse detection instrument such as, for example, a suitable pressure transducer 136 that can distinguish the periodic rhythm of the heart muscle. The blood pressure and the pulse rate are related. In mechanical terms, the heart muscle functions like a pump. If the beat of the heart muscle speeds up, the pressure in the veins and blood vessels correspondingly increases. As a result, the increased beat rate of the heart muscle also increases the blood pressure and the pulse rate.

The pulse and body temperature data periodically measured by the sensors 128 is transmitted via micro-conductors 138 circuited in the wrist band 126 to the appropriate electronic circuitry in the outer casing 124 of the wrist worn apparatus 102. This sensed and measured data can then be stored in a memory 140 and compared to a standard range for body temperature and pulse rate readings 142 in the comparator memory 140 to determine whether a particular sensed reading is normal or abnormal (e.g., vital parameter readings fall below or above the programmed limits) as determined by competent medical authority. It is noted that this sensed and measured data can also be utilized to measure the blood pressure of the monitored person by utilizing a blood pressure sensor 144 for sensing the systolic and diastolic pressure measurements in the blood vessels in the human wrist as shown in FIG. 1. For clarification purposes, the pressure transducer 136 can be incorporated into the circuitry of the blood pressure sensor 144 since the pressure transducer 136 detects the pulse rate and the pressure differential within the wrist vein of the monitored person is used to measure or calculate the blood pressure. Consequently, the vital parameters of body temperature, pulse rate and blood pressure can be measured and transmitted to the appropriate circuitry in the wrist worn apparatus 102 as shown in FIG. 2 and discussed in more detail herein below.

The memory storage component, e.g., the comparator memory 140 shown in FIG. 2 located within the wrist worn apparatus 102, also includes stored therein data associated with the monitored person including name, address, and pertinent medical information setting forth any relevant medical history. All of this information is directly provided in any uploading transmission to the closest medical response team 108 via the worldwide communication network 120 {and alternately to the emergency dispatcher call center 106 as a back-up route} along with the date, time, and the most current vital parameter readings of temperature, pulse rate and blood pressure resident in the comparator memory 140. Once the wrist worn apparatus 102 is programmed with the relevant data, it is positioned on the wrist of the monitored person, which can be, for example, the elderly, children, hikers, explorers, sports persons, military members, civil servants such as police and fire department personnel, and medically and mentally impaired individuals to name a few. During an emergency situation, the personal monitoring system 100 will assist the authorities in locating the monitored person and dispatch the closest medical response team 108 thereto for providing emergency medical services.

The wrist worn apparatus 102 is a mobile unit and thus is powered by an appropriate battery source 146 as is known in the art and shown in FIG. 2. Since it is desired that the wrist worn apparatus 102 be energized upon placing it on the wrist of the monitored person, the battery source 146 can be physically connected to the appropriate circuitry within the outer casing 124 by any of several methods. If the attached wrist band 126 of the wrist worn apparatus 102 is intended to fit snugly about the human wrist, an on-off switch 148 can be located on the rear side of the outer casing 124 for contacting the human wrist as shown in FIG. 3. In order to accomplish this goal, the wrist band 126 can be made adjustable to fit different size wrists or the wrist band 126 can be made of elastic material with the micro-conductors 138 circuited there through as shown in FIG. 1. The on-off switch 148 can be, for example, a pressure activated switch, possibly spring-loaded, located behind the outer casing 124 of the wrist worn apparatus 102, or in the alternative, {b} a body temperature switch similarly positioned behind the outer casing 124 of the wrist worn apparatus 102. In the case of an on-off switch 148 which is pressure activated, the switch 148 will be forced into the closed position to connect the battery source 146 via the micro-conductors 138 to the appropriate circuitry shown in FIG. 2 within the outer casing 124. In the case in which the on-off switch 148 is sensitive to the heat of the human body, the body temperature switch, upon closing, can be utilized to connect the battery source 146 via the micro-conductors 138 to the appropriate circuitry within the outer casing 124. In either example, the battery source 146 is connected to the array of sensor devices 128 as shown in FIG. 1 so that the electronic features associated with the array of sensor devices 128 will have a power source to energize the circuitry necessary to operate the wrist worn apparatus 102.

As with many prior art devices, the charge level of the battery source 146 can be monitored by the appropriate circuitry located within the wrist worn apparatus 102. The battery source 146 and a low voltage monitoring/battery charger circuit 150 are shown in FIG. 2 for providing the electrical power for energizing the wrist worn apparatus 102. Thus, when the battery charge level is low, a low voltage signal is generated which can activate an audible alarm 152 and/or a visual alarm 154. The audible alarm 152 which can be, for example, a beeping or buzzing device and the visual alarm 154 which can be, for example, a flashing light are both located on the top surface of the outer casing 124 of the wrist worn apparatus 102 as is shown in FIGS. 1 and 3. It is noted that the audible alarm 152 and the visual alarm 154 are the same devices actuated by abnormal vital biometric parameter readings which are detected by the comparator memory 140 and the standard range section 142. That is, if the updated vital parameter readings provided by the plurality or array of sensors 128 within the wrist band 126 of the wrist worn apparatus 102 do not fall within the normal standard range for these parameters stored within the standard range section 142 of the comparator memory 140, the audible alarm 152 and/or the visual alarm 154 will be activated. This feature of the present invention will be discussed in more detail herein below with reference to FIG. 2. Also located on the top surface of the outer casing 124 of the wrist worn apparatus 102 is a liquid crystal display (LCD) 156 utilized for providing various information for use by the monitored person such as, for example, the time, date, and system status information such as the low voltage notification. Also, a time/date indicator 158 for visually announcing the date and time on the liquid crystal display 156 and a medical history/personal data section 160 containing relevant information about the monitored person are each shown providing signal inputs to the comparator memory 140 in FIG. 2 for uploading to communication link 104. Further, an indication of the presence of a programmable logic controller 161 is also shown {in phantom} in both FIGS. 1 and 3 on the outer casing 124 of the mobile wrist worn apparatus 102.

Once the wrist worn apparatus 102 is fitted onto the wrist of the monitored person and is energized, the array of sensors 128 or sensor array 128 positioned in the wrist band 126 to sense the vital biometric parameters will periodically provide updated parameter readings to the comparator memory 140 shown in FIG. 2. The updated vital parameter readings are then compared to the stored standard range readings of the standard range section 142 for body temperature, pulse rate and blood pressure. If the updated readings do not fall within the range of the standard or average readings for those parameters stored in the standard range section 142, then an audio/visual alarm circuit 162 shown in FIG. 2 is actuated. The audio/visual alarm circuit 162 then enters the alarm mode by energizing both the audible alarm 152 (e.g., beeper or buzzer sound) and the visual alarm 154 (e.g., flashing light source). These two physical alarms 152 and 154 were previously mentioned above in relation to an alarm associated with a low voltage level of the battery source 146. Once actuated, both the audible alarm 152 and the visual alarm 154 will continue in the alarm mode on the wrist worn apparatus 102 for a predetermined limited time in the range of a few minutes.

Because all vital biometric parameter readings of the monitored person which fall outside of the normal range of the standard range section 142 of the comparator memory 140 do not indicate an actual emergency, a built-in time delay enables the monitored person (or her caretaker) to press an acknowledgment button 164 located on the outer casing 124 shown in FIG. 4. The acknowledgment button 164 is a novel feature of the present invention and serves to effectively change the status of the wrist worn apparatus 102 by entering codes therein. Various functions of the circuitry resident within the wrist worn apparatus 102 can be accomplished by entering different codes. Entering codes into the wrist worn apparatus 102 is accomplished by depressing the acknowledgment button 164 a specified number of times that correspond to a specific function. For example, the following code entries could be entered by a conscious person by utilizing a manual activation section 166 of the acknowledgment button 164 shown in FIG. 2 to accomplish the following various functions.

Suppose that {1} a conscious monitored person accidentally causes an event that triggers the audible alarm 152 and/or the visual alarm 154 when, in reality, no emergency condition actually exists. Under these conditions, the monitored person can depress the acknowledgment button 164, for example "once", to enter a "stop code" to prevent a false alarm, e.g., to prevent the wrist worn apparatus 102 from progressing to the broadcast mode. Depressing the acknowledgment button 164 "once" has the effect of opening an appropriate circuit to ensure that the alarm mode signal is reset to a rest mode. In the alternative, suppose that {2} the monitored person senses an emergency situation is about to occur such as, for example, she experiences dizziness or numbness in her arm or the slurring of speech or pain in her chest which might indicate an approaching "stroke" or heart attack. Under these conditions, the monitored person can depress the acknowledgment button 164 for example "twice" which will broadcast or transmit an emergency alarm signal to the communication link 104. Under these specific conditions, the acknowledgment button 164 functions as a "panic button" to transmit an emergency signal to the communication link 104 which will be directed to the closest medical response team 108. Now suppose that {3} there is an equipment failure such as, for example, in the case of a low battery voltage condition which will appear as the text "low battery" shown on the liquid crystal display (LCD) screen 156 of the wrist worn apparatus 102. Under these conditions, the acknowledgment button 164 can be depressed for example "three times" to deactivate the personal monitoring system 100 so that the battery source 146 can receive an electrical re-charging. It is noted that a battery charger (not shown) is included with the personal monitoring system 100 for the purpose of re-charging the battery source 146 when the charge level is below normal. If the monitored person is not able to depress the acknowledgment button 164 because an emergency does in fact exist, the personal monitoring system 100 will operate in the automatic mode and shift to the second phase of operation as is discussed herein below.

In the event that the monitored person experiences an actual emergency, the personal monitoring system 100 must be activated in order to function as intended. As shown in FIG. 2, the wrist worn apparatus 102 includes the appropriate circuitry. When the wrist worn apparatus 102 is removed by the monitored person, the personal monitoring system 100 simply de-activates (because the on-off switch 148 is no longer depressed). The battery source 146 provides the direct current voltage to the system components. Once the wrist worn apparatus 102 is donned by the monitored person, the on-off switch 148 such as, for example, the pressure switch is depressed and the voltage is applied to the system components. Then the monitored person enters the power "on/off code" through the acknowledgment button 164 to notify the personal monitoring system 100 that the monitored person is back on-line and the monitoring should continue. The array of sensors 128 continuously collects vital biometric parameters of temperature, pulse rate and blood pressure and delivers these parameters to the comparator memory 140 for comparison to the normal standard range for these parameters stored in the standard range section 142. At this stage, the wrist worn apparatus 102 can activate the personal monitoring system 100 by more than one method as will be discussed now.

A novel feature of the present invention is that the personal monitoring system 100 can be {1} activated automatically via the vital biometric parameters periodically measured by the array of sensors 128. In the alternative, the personal monitoring system 100 can be {2} activated manually by utilizing the manual activation section 166 and the acknowledgment button 164 as is shown in FIG. 2. We will begin this discussion with the {1} automatic activation method first, i.e., the personal monitoring system 100 is activated based upon the vital biometric parameter readings. In the immediate previous paragraph, the most current vital biometric parameter readings of the monitored person have been compared to the normal standard range for these parameters stored in the standard range section 142. If the magnitude of the current vital parameter readings do not fall within the normal standard range for these parameters, a comparator signal is transmitted to the audio-visual alarm circuit 162 shown in FIG. 2 for creating an emergency alarm signal. This emergency alarm signal will then actuate the audible alarm 152 (e.g., buzzer) and/or the visual alarm 154 (e.g., flashing light). This automatic activation method will function whether the monitored person is conscious or unconscious.

Let us assume that the monitored person is conscious but unresponsive and that the acknowledgment button 164 was not depressed. Under these conditions, the signal transceiver 130 with the GPS unit built-in and shown in FIG. 2 initiates the broadcast mode after a delay of approximately one minute. It is understood that the operation of the signal transceiver 130 is under the programmed control of the programmable logic controller 161 as is shown in FIG. 2. The signal transceiver 130 emits the transmission signal 110 from the antenna 112 if and only if the monitored person does not enter the "stop code" by depressing the acknowledgment button 164 the appropriate number of times. However, if we assume that the monitored person is conscious (notwithstanding an event such as falling down) but that no emergency actually exists notwithstanding the most current absolute values of the vital parameter readings, the monitored person may depress the acknowledgment button 164 to enter the "stop code". Entering the "stop code" will stop the personal monitoring system 100 from actuating the signal transceiver 130 and entering the broadcast mode. Under these conditions, an approximately three minute delay is experienced which provides time for the monitored person to stabilize from the event such as the fall. However, if the personal monitoring system 100 then responds to abnormal vital biometric parameter readings, the monitored person can once again enter the "stop code" using the acknowledgment button 164. In the alternative, if the monitored person decides that an emergency does now exist after the three minute delay, she can permit the second emergency alarm (based on the abnormal vital parameter readings) to actuate the signal transceiver 130 and cause the antenna 112 to enter the broadcast mode to seek help.

Now let us assume that the monitored person is unconscious such as, for example, she hit her head on a rock when she fell down. Further, let us assume that the next successive vital biometric parameter readings do not fall within the normal range for these temperature, pulse rate and blood pressure readings. The programmable logic controller 161 automatically responds to the emergency situation from the abnormal vital biometric parameter readings. Then, the audio-visual alarm circuit 162 generates the emergency alarm signal and the audible alarm 152 and the visual alarm 154 are energized. Under these conditions, the emergency alarm signal is transmitted by the signal transceiver 130 via the antenna 112 under the control of the programmable logic controller 161. The vital parameter readings, the medical history of the monitored person, the exact time and date, and the GPS location coordinates of the monitored person are all uploaded to the communication link 104 and then re-transmitted via re-transmission signal 118 directly to the closest medical response team 108 to initiate the rescue and emergency medical treatment as shown in FIGS. 1 and 2. It is noted that the programmable logic controller 161 also automatically responds to the emergency situation by identifying, locating and continuously directly communicating with the closest medical response team 108. Consequently, the closest medical team is forewarned of the emergency situation.

In the alternative method, the personal monitoring system 100 can be activated manually by utilizing the manual activation section 166 and the acknowledgment button 164 as is shown in FIG. 2. This method of manual activation of the personal monitoring system 100 is referred to as "self-activation" by the conscious monitored person. In an example, suppose that the monitored person has a broken leg as a result of a fall while hiking. Under these conditions, the monitored person can depress the acknowledgment button 164 for example "twice" which will broadcast or transmit an emergency alarm signal directly to the closest medical response team 108 via the communication link 104. Under these specific conditions, the acknowledgment button 164 functions as a "panic button" to transmit the emergency alarm signal to the communication link 104 which will be relayed to the closest medical response team 108. Furthermore, if the monitored person having the broken leg depresses the acknowledgment button 164 which functions as a "panic button", a one minute delay is instituted to allow the monitored person to terminate the call for help if she decides that an emergency situation does not actually exist. The monitored person then depresses the acknowledgment button 164 the appropriate number of times to initiate the "stop code" which terminates the "panic call" and avoids an accidental alarm situation. The personal monitoring system 100 will then not transmit the emergency alarm signal in accordance with the "stop code".

In the event of an actual emergency during which the automatic operation of the personal monitoring system 100 is operable, the acknowledgment button 164 is usually not depressed. Under these conditions, the emergency alarm signal generated by the audio-visual alarm circuit 162 shown in FIG. 2 will be maintained. The signal transceiver 130 will deliver the emergency alarm signal to the antenna 112 which will then broadcast the transmission signal 110 via the communication link 104 and the worldwide communication link 120 in order to directly communicate with the closest medical response team 108. It is noted that communication is also established with the dispatcher call center 106 as a secondary back-up means to reaching the closest medical response team 108. The broadcast function can be accomplished with at least two options. The broadcast mode can utilize the facilities of {1} the existing Global Positioning System (GPS) satellite 116 or, in the alternative, the facilities of {2} the existing cell phone repeater tower or station 114. Each of these options which can function as the communication link 104 are shown in both FIGS. 1 and 2. The broadcast mode is facilitated by the signal transceiver 130 incorporated within the wrist worn apparatus 102. The emergency alarm signal is forwarded to the signal transceiver 130 which generates the transmission signal 110 having suitable wave propagation characteristics which is broadcast from the antenna 112 positioned on the wrist worn apparatus 102. The transmission signal 110 is then intercepted by the receiver circuit of {a} the nearest cell phone tower repeater station 114 or {b} the Global Positioning System (GPS) satellite station 116, whichever facility is available.

The emergency alarm signal sent to the signal transceiver 130 and broadcast by the antenna 112 contains the personal identification information and address, vital biometric parameter readings, and medical history information of the monitored person that is stored in the comparator memory 140. The signal transceiver 130 then encodes this information of the monitored person and broadcasts it in the encoded format to either {a} the receiver circuit of the nearest cell phone tower repeater station 114, or {b} the receiver circuit of the Global Positioning System (GPS) satellite 116. It is noted that when the encoded signal containing the intelligence information of the monitored person is broadcast to the receiver circuit of the nearest cell phone tower repeater station 114, it processes the encoded signals. The processing typically includes amplification and then forwards the amplified encoded signals directly to the closest medical response team 108 through the worldwide communication network 120 via the re-transmission signal 118. It is noted that the character of the received encoded signal adopts the frequency profile of a cell phone signal for enabling the closest medical response team 108 to receive and decode the signal. The received signal is then decoded by the worldwide communication network 120 and forwarded to the medical response team 108 closest to the monitored person as shown in FIG. 2. In the alternative, the encoded signal containing the intelligence information received by the Global Positioning System (GPS) satellite 116 typically located in a stationary orbit above the surface of the Earth is likewise processed, amplified and directed via the re-transmission signal 118 to the worldwide communication network 120, for example, the Internet. The received amplified encoded signal which is now available on the Internet link is directly forwarded to the closest medical response team 108 also shown in FIGS. 1 and 2.

The worldwide communication network 120 receives, processes and amplifies the re-transmission signal 118 including the personal history, medical, vital biometric parameter readings, location information and identified medical response team 108 directed to the monitored person. This information is then processed and decoded for use and is provided directly to the identified medical response team 108 located closest to the site of the emergency. Upon reaching the monitored person who is wearing the mobile wrist worn apparatus 102, the paramedic/medical response team 108 can deliver emergency medical services and arrange for the transfer of the monitored person to an appropriate medical facility. Further, the medical facility {not shown} will also have been notified of the arriving monitored person by an appropriate means. In this manner, the monitored person suffering from the injury or impairment receives the needed medical care with the minimum of time delay which is a significant feature of the present invention.

The personal monitoring system 100 also includes the data base center 122 which receives the re-transmission signal 118 directly or indirectly from either {a} the cell phone tower repeater station 114, or {b} the global positioning system (GPS) satellite 116 via the worldwide communication network 120 as is shown in FIGS. 1 and 2. Thus, the data base center 122 receives the broadcast information transmitted by the signal transceiver 130 shown in FIG. 2 which includes the identification information, medical history, time and date, exact GPS location coordinates, the vital biometric parameter readings of the monitored person and the location of the medical response team 108 identified by the programmable logic controller 161 within the mobile wrist worn apparatus 102. It is noted that each monitored person who becomes a subscriber through a purchase or lease of the personal monitoring system 100 of the present invention will provide detailed personal information for inclusion into a separate electronic file via an appropriate software program to form a data base. This electronic file data base will be stored in the data base center 122 and will include the transmitted broadcast information from the signal transceiver 130. Further, the data base center 122 is connected to the medical response team 108 via a telephone connection 168 as shown in FIGS. 1 and 2. Consequently, the data base center 122 functions as a back-up to the cell phone tower repeater station 114 and the global positioning system (GPS) satellite 116 to ensure that the broadcast information reaches the medical response team 108 located closest to the monitored person. Since the data base center 122 also receives the information broadcast from the signal transceiver 130 and is manned by human beings, the telephone connection 168 can be utilized to ensure that the medical response team 108 has been notified of the emergency situation.

The personal monitoring system 100 is constructed so as to be highly shock resistant and water resistant. For example, the outer casing 124 of the wrist worn apparatus 102 can be fashioned from a modern high strength but flexible plastic material that resists damage from the shock of being dropped but also can be manufactured to such tolerances as to be resistant to damage if exposed to moisture. Furthermore, if the monitored person removes the wrist worn apparatus 102 from her wrist, the battery source 146 will be disconnected particularly when the on-off switch 148 located on the rear side of the outer casing 124 is the spring-loaded, pressure activated switch or the body temperature switch previously mentioned. Thus, upon removal, the wrist worn apparatus 102 is de-energized which is an energy efficiency feature designed into the present invention to extend the life of the battery source 146. Upon reapplying the wrist worn apparatus 102 to the human wrist, depression of, for example, the pressure activated, on-off switch 148, and then the keying in of the proper code using the acknowledgment button 164 results in the wrist worn apparatus 102 being reactivated to the operational mode. Another important feature of the design of the present invention is the successful integration of all circuit design components to be compatible with the wrist worn apparatus 102. Because the monitored person who subscribes to the use of the personal monitoring system 100 will necessarily communicate with emergency responders such as, for example, hospitals, paramedics, and fire departments, it may be necessary to develop an appropriate software program to assist the responders in receiving and directing incoming information from the wrist worn apparatus 102. Such a software program would streamline the communication links among the emergency responders. Further, such a program would also be useful in military and naval applications.

Figure 4A:
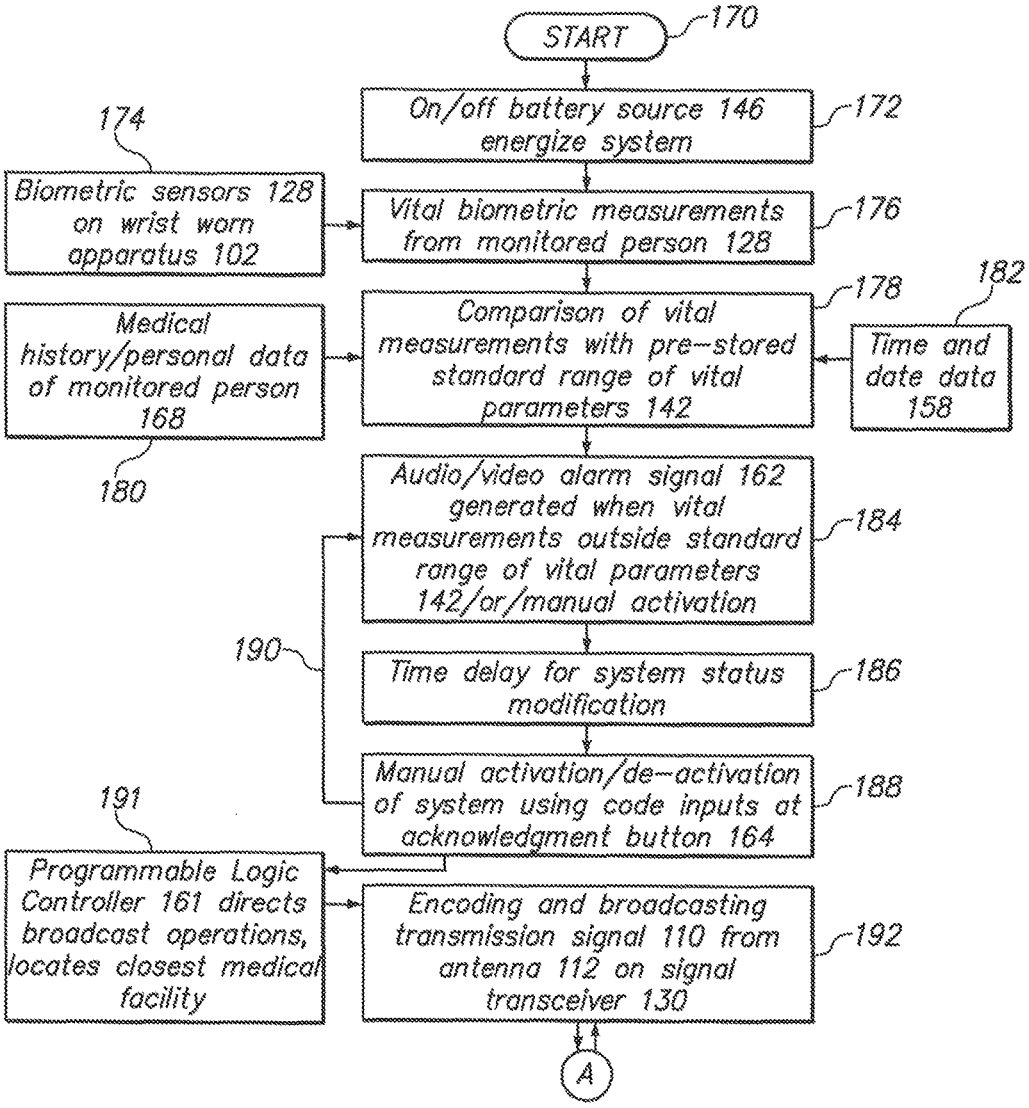
FIG. 4A is a flow diagram showing the steps in the process practiced by the personal monitoring and emergency communications system and method of FIG. 1 showing the step of providing a direct current voltage source to the appropriate circuitry-to-the step of encoding and broadcasting a transmission signal from a signal transceiver during an emergency.
Figure 4B:
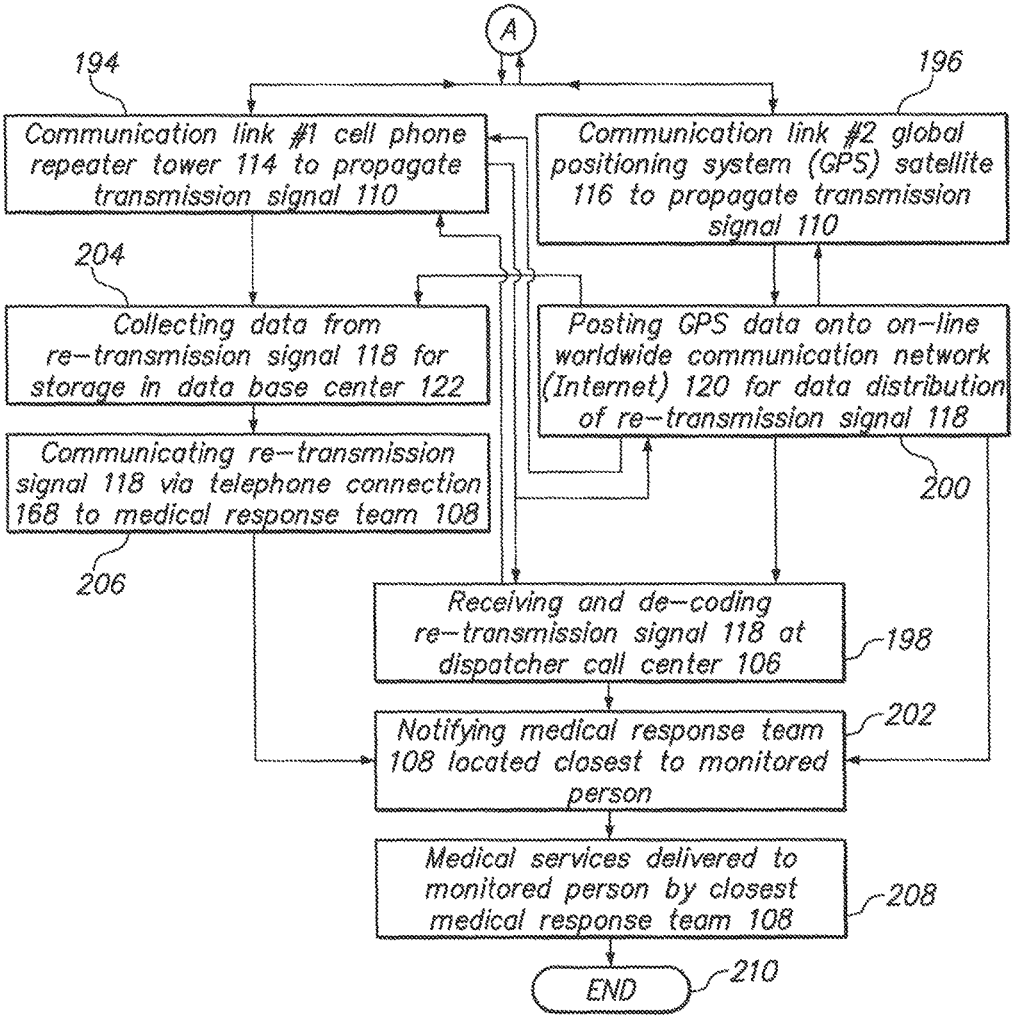
FIG. 4B is a continuation of the flow diagram of FIG. 4A showing the steps in the process practiced by the personal monitoring and emergency communications system and method of FIG. 1 showing the step of receiving the broadcasted transmission signal by either a first cell phone tower communication link or a second global positioning system communication link-to-the step of medical services being provided to the monitored person during the emergency.

We will now turn our attention to the operation of the personal monitoring and emergency communications system and method 100 of the present invention by making reference to the operational flow diagram appearing on FIGS. 4A-4B accompanying this application. An identification number will be assigned to each step in the process to assist the reader in following the operational flow diagram. In a preferred embodiment, we begin with a first Step 170 identified as "START" on FIG. 4A which initiates the operation of the personal monitoring system 100. When the monitored person is participating in relevant activities {such as, for example, hiking, skiing, activities outside an assisted living facility, etc.} and the wrist worn apparatus 102 is wrapped about her wrist, the personal monitoring system 100 is ready for use. Once the battery source 146 is charged and the "on-code" has been entered via the acknowledgment button 164 as shown in Step 172, the system is ready for activation. Activation of the personal monitoring system 100 is achieved either automatically or manually once an emergency has occurred.

The standard automatic activation procedure will now be discussed as shown in FIG. 4A. In the automatic activation procedure, the array of biometric sensors 128 resident in the attached wrist band 126 of the wrist worn apparatus 102 is in contact with the blood vessels in the human wrist as is described with reference to FIG. 1 and as shown in Step 174 in FIG. 4A. The periodic measurement readings of the vital parameters of the monitored person as measured by the array of sensors 128 are shown in Step 176. It is these periodic measurements that determine whether the personal monitoring system 100 will activate automatically and transmit an alarm signal for assistance. The determination of whether the personal monitoring system 100 is automatically activated in the comparison Step 178 is shown next. The comparison Step 178 represents the step of periodically comparing the vital biometric measurements of the monitored person with the pre-stored standard range 142 of these vital parameters of temperature, pulse rate and blood pressure. If the vital biometric parameters periodically measured by the array of sensors 128 fall outside of the standard range of measurements 142 as determined by competent medical authority and stored in the comparator memory 140 (see FIG. 2), then a comparator signal is generated. Additionally, the medical history and personal data of the monitored person 160 shown in Step 180 and the relevant time and date data 158 shown in Step 182 are also shown as inputs to the comparison Step 178 in FIG. 4A. In this manner, if an alarm signal is generated by the audio-visual alarm circuit 162, then all of this information is uploaded to the communication link 104 via the antenna 112 of the signal transceiver 130 and broadcast to the worldwide communication network 120 as shown in FIG. 2.

If the periodic vital biometric measurements of temperature, pulse rate and blood pressure of the monitored person is within the standard range 142 as pre-stored in the comparison memory 140, then the difference between the periodic measurements and the pre-stored standard range 142 of these vital parameters is insufficient to trigger an alarm signal. Consequently, an alarm signal is not generated and the personal monitoring system 100 is not activated. However, if the difference between the periodic measurements of the vital parameters of the monitored person and the pre-stored standard range 142 of these parameters is sufficiently large, the alarm signal is generated as is indicated at Step 184 in FIG. 4A. When the alarm signal is generated, the audio-visual alarm circuit 162 also triggers the audible alarm 152 (ex: such as a buzzer) and the visual alarm 154 (ex: such as a flashing light) to provide a local alarm to the monitored person or her caretaker as shown in FIG. 1. Further, the alarm signal can also be generated by the monitored person by entering the proper code into the wrist worn apparatus 102 by utilizing the acknowledgment button 164. An example of the monitored person entering a pre-programmed code into the wrist worn apparatus 102 to generate an alarm signal is when the monitored person senses an on-coming change in her immediate health such as, for example, a stroke or heart attack or a physical injury.

Once the alarm signal is generated, there is a brief time delay programmed into the procedure as shown as Step 186 for up to a few minutes to enable the monitored person to modify the status of the personal monitoring system 100. This status modification of the personal monitoring system 100 is accomplished by entering a pre-programmed code via the acknowledgment button 164 as is shown in Step 188 in FIG. 4A. Examples include de-activating the alarm signal by entering a "Stop Code" when an emergency situation does not actually exist in order to avoid a false alarm. This action is accomplished by feeding back a suitable de-activation signal along line 190 to the audio-video alarm signal in Step 184 to terminate the alarm signal. In the alternative, the monitored person can identify an impending emergency and manually enter the suitable code in anticipation of the emergency such as, for example, the early signs of the failure of a bodily function. Under these conditions, a suitable activation signal is fed back along line 190 via the acknowledgment button 164 to generate the audio-visual alarm signal shown in Step 184. This action results in the manual activation of the personal monitoring system 100. Assuming that the alarm signal 162 is generated in Step 184 and that a code was not entered via the acknowledgment button 164, the alarm signal 162 activates the programmable logic controller 161 shown in Step 191 in FIG. 4A for directing the broadcast operations and locating the medical response team 108 closest to the monitored person. Upon the generation of an alarm signal 162 as shown in Step 184 in FIG. 4A, whether the alarm signal 162 is automatically generated via the periodic vital biometric parameters 128 of the monitored person or whether the monitored person entered an alarm code via the acknowledgment button 164, the operation of the personal monitoring system 100 is controlled by the programmable logic controller (PLC) 161 shown in Step 191. Thereafter, the alarm signal results in the encoding and broadcasting of the transmission signal 110 from the antenna 112 on the signal transceiver 130 as is shown in Step 192 on FIG. 4A.

Referring now to FIG. 4B, the broadcasting of the transmission signal 110 from the wrist worn apparatus 102 to the pair of communication links 104 is now disclosed. The propagation of the transmission signal 110 can be completed by one of two parallel paths as is shown in the block diagram of FIG. 2 and in the flow diagram of FIG. 4B. The particular path that actually carries the transmission signal 110 is determined by which pathway is available. The propagation of the transmission signal 110 can be forwarded by the cell phone tower repeater station 114 as is shown in Step 194. However, if a cell phone tower repeater station 114 is not conveniently available, the propagation of the transmission signal 110 can be re-transmitted by the global positioning system (GPS) satellite 116. It is understood that the two communication links 104 are mutually exclusive, that is, if a local cell phone tower repeater station 114 re-transmits the transmission signal 110, then the global positioning system (GPS) satellite 116 does not re-transmit the transmission signal 110 and visa versa.

Initially, let us assume that upon the broadcasting by the transceiver 130, the receiver circuit of the cell phone tower repeater station 114 intercepts the transmission signal 110 propagated by the antenna 112 in the mobile wrist worn apparatus 102 as shown in Step 194. The received re-transmission signal 118 from the cell phone tower repeater station 114 is then directly received and decoded at the worldwide communication network 120 as shown in Step 200. This action is made possible by the reciprocal lines between the cell phone tower repeater station 114 shown in Step 194 and the worldwide communication network 120 appearing in Step 200 indicating two-way communication as is shown in FIG. 4B. The worldwide communication network 120 shown in Step 200 then directly communicates with the medical response team 108 located closest to the monitored person by a direct connection as is shown in Step 202 and in FIG. 2. Additionally, the re-transmission signal 118 from the cell phone tower repeater station 114 shown in Step 194 is also received and decoded at the dispatcher call station 106 as shown in Step 198. This action is made possible by the reciprocal lines between the cell phone tower repeater station 114 shown in Step 194 and the dispatcher call center 106 shown in Step 198. This connection between the cell phone tower 114 shown in Step 194 and the dispatcher call center 106 shown in Step 198 indicates two-way communication but is a secondary back-up means for notifying the medical response team 108 located closest to the monitored person of the existing emergency as shown in Step 202.

In the alternative, upon broadcasting, the receiver circuit of the global positioning system (GPS) satellite 116 will intercept the transmission signal 110 propagated by the antenna 112 in the mobile wrist worn apparatus 102 as shown in Step 196. The received re-transmission signal 118 from the global positioning system (GPS) satellite 116 is then posted or published onto the on-line worldwide communication network 120 such as the Internet for data distribution as is shown in Step 200 in FIG. 4B. This action is made possible by the reciprocal lines between the global positioning system (GPS) satellite 116 shown in Step 196 and the worldwide communication network 120 shown in Step 200 indicating two-way communication as is shown in FIG. 4B. Thereafter, the information carried by the re-transmission signal 118 and posted on the worldwide communication network 120 (e.g., the Internet) as shown in Step 200 is directed to the dispatcher call center 106 as is shown in Step 198 as a secondary back-up means for notifying the medical response team 108 located closest to the monitored person of the existing emergency. Thereafter, the received and decoded information from the re-transmission signal 118 is forwarded to the medical response team 108 closest to the monitored person as notification of the emergency as is shown in Step 202 in FIG. 4B.

Notwithstanding the alternative pathways provided by the cell phone tower repeater station 114 shown in Step 194 and the global positioning system (GPS) satellite 116 shown in Step 196, the present invention provides the back-up pathway via the data base center 122 as shown in Step 204. In Step 204, the data carried by the re-transmission signal 118 is received and collected in the data base center 122 and is facilitated by the inputs from the cell phone tower repeater station 114 in Step 194 and the on-line worldwide communication network 120 (e.g., the Internet) shown in Step 200. Consequently, notwithstanding whichever of the pair of parallel communication links 104 delivers the re-transmission signal 118, it is forwarded to the data base center 122 as is shown in Step 204 in FIG. 4B. Next, the information associated with the re-transmission signal 118 (e.g., relating to the emergency situation involving the monitored person) is communicated by the personnel assigned to the data base center 122 via the telephone connection 168 to the closest medical response team 108 as shown in Step 206. Thereafter, the notified medical response team 108 located closest to the situs of the emergency prepares for and then delivers the required medical services to the monitored person as is shown in Step 208. The final step in the flow diagram shown in FIG. 4B is identified as END 210. The procedure is now complete unless interrupted by a pre-programmed code that would be entered at Step 188 shown in FIG. 4A. The personal monitoring system 100 is now ready to repeat the procedure beginning with the START Step 170.

It is emphasized that whichever of the pair of parallel communication links 104 is utilized to forward the re-transmission signal 118, the primary pathway is via the worldwide communication network 120 (e.g., the Internet). The reason for this action is that the information can be delivered to the medical response team 108 much quicker via the worldwide communication network 120 (e.g., the Internet) than by the dispatcher call center 106. The reason is that the speed of delivery of the notification of the emergency situation to the medical response team 108 from the dispatcher call center 106 depends on the administrative personnel assigned to the dispatcher call center 106. Consequently, the direct transmission of the re-transmission signal 118 from the communication link 104 to the worldwide communication network 120 (e.g., the Internet) enables a more rapid forwarding of the information in digital format to the medical response team 108 closest to the monitored person. Consequently, the purpose of the digital call center 106 is as a secondary back-up means for ensuring that the re-transmission signal 118 reaches the closest medical response team 108 promptly. Because of the design disclosed herein, the dispatcher call center 106 {a} is alerted that the mobile wrist worn apparatus 102 has broadcast the transmission signal 110 (as shown in FIG. 1), and {b} knows that the medical response team 108 closest to the monitored person has been contacted.

Likewise, the mobile wrist worn apparatus 102 is cognizant that: {a} the transmission signal 110 has been dispatched via the transceiver 130 to the closest medical response team 108; and that the transmission signal 110 contains {b} the identification and medical history of the monitored person; {c} the GPS location coordinates and recent vital measurements of the monitored person, {d} continues to measure the vital parameters of the monitored person; {e} continues to periodically send updated measurements of the vital parameters to the medical response team 108; {f} that the updated measurements of the vital parameters are utilized by the closest medical response team 108 in preparation to treat the monitored person; and {g} permits the medical response team 108 to communicate with a designated hospital facility. A two-way communication continues between the mobile wrist worn apparatus 102 and the medical response team 108 closest to the monitored person which is indicated by the reciprocal arrows appearing on FIGS. 1, 2, and 4B.

It is emphasized that the mobile wrist worn apparatus 102 is the key component of the personal monitoring system 100 of the present invention. This is the case for many reasons and particularly since the mobile wrist worn apparatus 102 {a} incorporates the programmable logic controller 161 as shown in FIGS. 1-2 that automatically makes all the decisions associated with the rescue of the monitored person during an emergency situation; {b} is capable of being programmed to allow decisions to be arrived at automatically; {c} determines the GPS location coordinates of the monitored person; {d} utilizes the GPS location coordinates to find the medical personal team 108 closest to the monitored person; (e) automatically broadcasts the transmission signal 110 containing all of the monitored person's personal and medical data for contacting the pair of parallel communication links 104 comprising the cell phone tower 114 and the GPS satellite 116; and {f} continues to provide updated measured vital parameters of the monitored person in a communication exchange with the medical response team 108.

Figure 5:
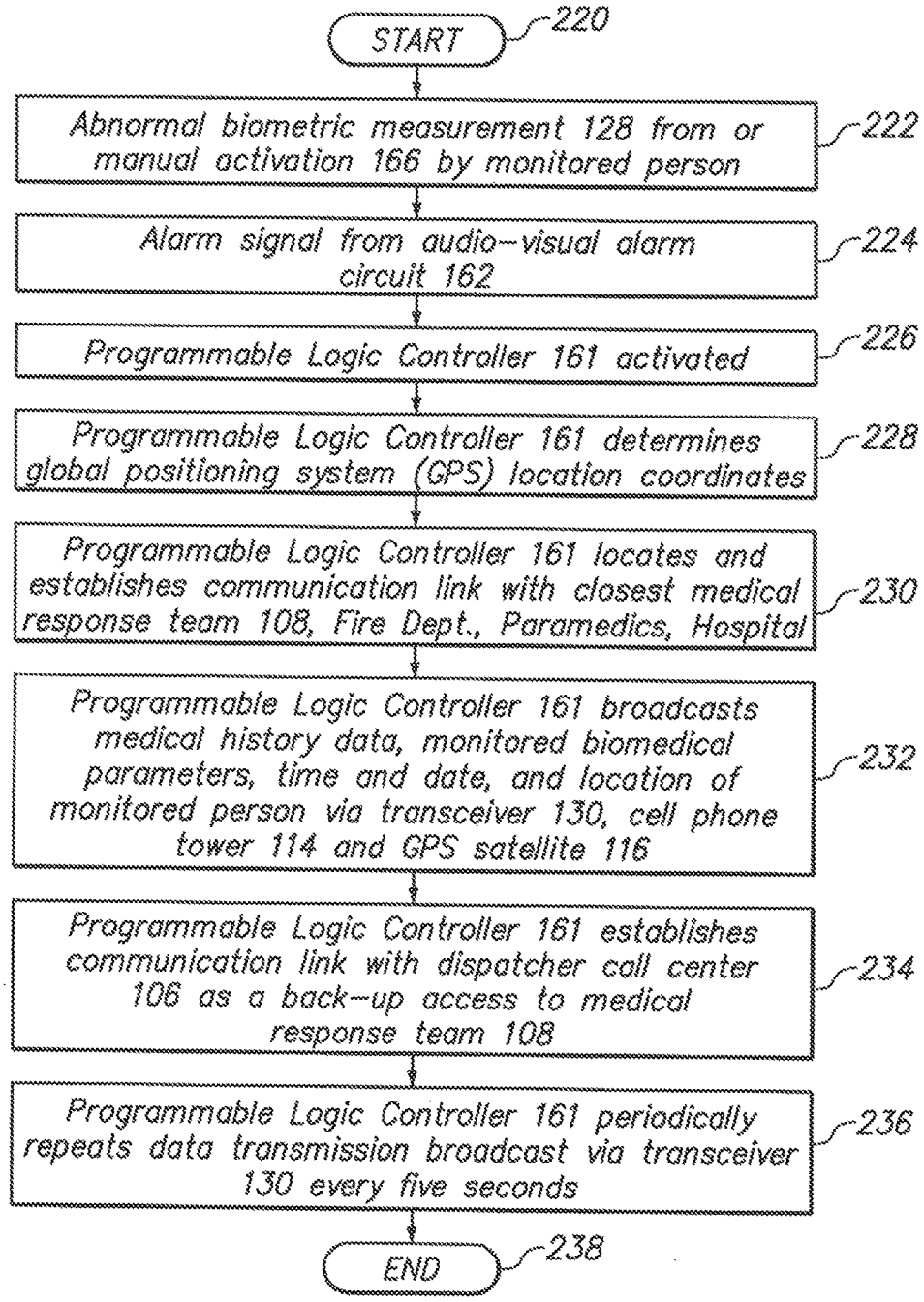
FIG. 5 is a flow diagram showing the steps in the control process of the programmable logic controller resident within the mobile wrist worn apparatus of the personal monitoring and emergency communications system and method of FIG. 1 illustrating the steps in the software decision making process of detecting the abnormal vital biometric parameters of the monitored person and actuating and broadcasting an alarm signal indicating an emergency situation, actuating the programmable logic controller (PLC), determining the GPS location coordinates, identifying and communicating with the closest medical response team, broadcasting the medical data of the monitored person, communicating with a dispatcher call center as a secondary path to the medical response team, and continuously re-broadcasting the medical data of the monitored person.

We will now turn our attention to the operation of the programmable logic controller 161 that upon receiving a valid signal from the alarm circuit 162, controls the operation of the mobile wrist worn apparatus 102. FIG. 5 is a flow diagram showing the steps in the control process of the programmable logic controller 161 resident within the mobile wrist worn apparatus 102 of the personal monitoring and emergency communications system and method 100 of FIG. 1 illustrating the steps in the software decision making process of detecting the abnormal vital biometric parameters of the monitored person and actuating and broadcasting the alarm signal 162 indicating an emergency situation, actuating the programmable logic controller (PLC) 161, determining the GPS location coordinates, identifying and communicating with the closest medical response team 108, broadcasting the personal and medical data of the monitored person, communicating with the dispatcher call center 106 as a secondary path to the medical response team 108, and continuously re-broadcasting the medical data of the monitored person.

In a preferred embodiment, we begin with the Step 220 in FIG. 5 which is labeled START. At this point, any abnormal biometric measurement 128 discovered in the comparator memory 140 or, in the alternative, any manual entering of a system code {e.g., a Stop Code} indicated by the box labeled manual activation 166 in FIG. 2 is detected in Step 222. This situation actuates the audio-visual alarm circuit 162 which generates an alarm signal as shown in Step 224 in FIG. 5. It is the generation of this alarm signal that initiates the operation of the personal monitoring system 100. Upon the generation of an alarm signal 162 {as shown in Step 184 in FIG. 4A} and notwithstanding whether the alarm signal 162 is automatically generated via an abnormal vital biometric parameter 128 of the monitored person or whether the monitored person entered an alarm code via the acknowledgment button 164, the operation of the personal monitoring system 100 is then controlled by the programmable logic controller (PLC) 161 shown in FIG. 2. This action causes the programmable logic controller 161 to be activated as is indicated by Step 226 in FIG. 5.

The smart software of the programmable logic controller (PLC) 161 performs several functions as soon as an alarm signal 162 is generated. First, the GPS location coordinates of the monitored person are determined by the GPS circuitry located in the programmable logic controller 161 as shown in Step 228. Next, the programmable logic controller 161 utilizes those GPS location coordinates of the monitored person to comparison search a data storage bank within the programmable logic controller 161 to identify the medical facility and medical response team 108 closest to the monitored person. The programmable logic controller 161 then establishes a communication link with the medical response team 108 {and possibly a hospital, fire department, etc.} located closest to the monitored person as shown in Step 230. Then, the programmable logic controller 161 broadcasts all the medical and location data of the monitored person via the transceiver 130 and antenna 112 to the global positioning system (GPS) satellite 116 and/or the cell phone tower 114 for direct transmission to the medical response team 108 via the worldwide communication network 120 as shown in Step 232. The broadcasted medical and location data of the monitored person includes the medical history data, monitored biometric parameters, actual time and date of the broadcast, the GPS location coordinates of the monitored person, and the identification and location of the medical response team 108 closest to the monitored person. After the programmable logic controller 161 establishes a communication link primarily with the closest medical team 108, the programmable logic controller 161 establishes a secondary communication link with the dispatcher call center 106 as a back-up means to communicate with the closest medical response team 108 as shown in Step 234. Thereafter, the programmable logic controller 161 periodically repeats the data transmission broadcast via the transceiver 130 and antenna 112 from the mobile wrist worn apparatus 102, for example, every five seconds as shown in Step 236. The final step in the process is identified as END in Step 238 after which the procedure is reset and ready to actuate again at the introduction of another alarm signal from the alarm circuit 162.

Thus, the preferred embodiment of the present invention is generally directed to a personal monitoring and emergency communications system and method 100 for use in an emergency that enables the prompt locating, diagnosing and initial treating of a monitored person during exigent circumstances such as during physical injury or mental impairment. The present invention includes a mobile wrist worn apparatus 102 carried by a monitored person for minimizing emergency response time notwithstanding the conscious state of the monitored person and including an array of sensors 128 for periodically sensing vital biometric parameters of the monitored person, a memory 140 for storing and comparing the sensed vital parameters to a pre-stored standard range 142 of the vital parameters for providing a comparator signal, an alarm circuit 162 for evaluating the comparator signal for providing an emergency alarm signal when the sensed vital parameters are not within the pre-stored standard range (e.g., vital parameters fall below or above the programmed limits), and a programmable logic controller (PLC) 161 for automatically responding to an emergency including broadcasting the alarm signal from a signal transceiver 130 to a worldwide communication network 120 via a pair of parallel communication links 104 for locating and continuously communicating the monitored person's data including the exact time 158, determined location coordinates, and the vital parameters and a medical history 160 directly to the closest medical response team 108 for providing emergency medical services while minimizing response time.

The present invention provides novel advantages over other emergency communications systems known in the prior art including those intended to monitor persons having physical disabilities and mental impairments. A main advantage of the personal monitoring and emergency communications system 100 and method of the present invention for use in an emergency that enables the prompt locating, diagnosing and initial treating of a monitored person is a programmable logic controller 161: {1} having the capability of automatically making all the decisions associated with the rescue of the monitored person during an emergency situation; {2} being programmed to allow all decisions to be arrived at automatically; {3} that determines the GPS location coordinates of the monitored person; {4} that utilizes the GPS location coordinates to find the medical response team 108 closest to the monitored person; {5} that automatically broadcasts the transmission signal 110 containing all of the monitored person's personal and medical data for contacting the pair of parallel communication links 104 comprising the cell phone tower 114 and the GPS satellite 116; {6} that continues to provide updated measured vital parameters of the monitored person in a communication exchange with the medical response team 108; {7} that automatically activates the personal monitoring system 100 based upon periodic vital biometric parameter readings that fall outside the normal range of those vital parameter readings; {8} that provides alternative manual activation of the personal monitoring system 100 during an impending emergency recognized by the monitored person; and {9} using the acknowledgment button 164 for enabling various codes to be entered into the wrist worn apparatus 102 for modifying the operation of the personal monitoring system 100.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility such as, for example, military rescue applications. It is therefore intended by the appended claims to cover any and all such modifications, applications and embodiments within the scope of the present invention. Accordingly,

What is claimed is:

1. A personal monitoring and emergency communications system comprising:

a mobile wrist worn apparatus carried by a monitored person for minimizing response time during an emergency notwithstanding the conscious state of said monitored person, said mobile wrist worn apparatus including;

an array of sensors for periodically sensing a plurality of vital biometric parameters of said monitored person;

a memory for storing and comparing said sensed vital parameters to a pre-stored standard range of said vital parameters for providing a comparator signal;

an alarm circuit for evaluating said comparator signal and for providing an emergency alarm signal for remote transmission when said vital parameters are not within said pre-stored standard range; and a programmable logic controller for automatically responding to an emergency including activating, encoding and broadcasting said emergency alarm signal from a signal transceiver to a worldwide communication network via either one of a pair of parallel communication links for continuously communicating the exact time, determining location coordinates, said vital parameters and a medical history of said monitored person and for identifying and continuously directly communicating with a medical response team closest to said monitored person for providing emergency medical services.

2. The personal monitoring and emergency communications system of claim 1 wherein said wrist worn apparatus further includes an antenna for transmitting said emergency alarm signal.

3. The personal monitoring and emergency communications system of claim 1 wherein said vital biometric parameters include a plurality of current body measurements comprising body temperature, pulse and blood pressure.

4. The personal monitoring and emergency communications system of claim 1 wherein said comparator memory further stores said medical history and personal data of said monitored person.

5. The personal monitoring and emergency communications system of claim 1 wherein said emergency alarm signal actuates an audio alarm and a visual alarm on said wrist worn apparatus.

6. The personal monitoring and emergency communications system of claim 1 wherein said wrist worn apparatus further includes a pressure-activated, on-off switch.

7. The personal monitoring and emergency communications system of claim 1 wherein said wrist worn apparatus further includes a body temperature, on-off switch.

8. The personal monitoring and emergency communications system of claim 1 wherein said communication link is a global positioning system satellite.

9. The personal monitoring and emergency communications system of claim 1 wherein said communication link is a cellular telephone tower.

10. The personal monitoring and emergency communications system of claim 1 wherein said array of sensors are located in a wristband of said wrist worn apparatus.

11. The personal monitoring and emergency communications system of claim 1 further including a battery source for providing electrical power to said wrist worn apparatus.

12. A personal monitoring and emergency communications system comprising:

a mobile wrist worn apparatus carried by a monitored person for minimizing response time during an emergency notwithstanding the conscious state of said monitored person, said wrist worn apparatus including;

an array of sensors for periodically sensing a plurality of vital biometric parameters of said monitored person;

a memory for storing and comparing said sensed vital parameters to a pre-stored standard range of said vital parameters for providing a comparator signal;

an alarm circuit for evaluating said comparator signal and for providing an emergency alarm signal for remote transmission when said vital parameters are not within said pre-stored standard range;

an acknowledgment button positioned on said mobile wrist worn apparatus for entering a specified code for modifying the operation of said mobile wrist worn apparatus; and a programmable logic controller for automatically responding to an emergency including activating, encoding and broadcasting said emergency alarm signal from a signal transceiver to a worldwide communication network via either one of a pair of parallel communication links for continuously communicating the exact time, determining location coordinates, said vital parameters and a medical history of said monitored person and for identifying and continuously directly communicating with a medical response team closest to said monitored person for providing emergency medical services.

13. The personal monitoring and emergency communications system of claim 12 wherein said wrist worn apparatus further includes a clock for providing said exact time.

14. The personal monitoring and emergency communications system of claim 12 wherein depressing said acknowledgment button a specified number of times resets a false alarm signal.

15. A method for providing remote monitoring and communications with a person during an emergency, said method comprising the steps of:

providing a mobile wrist worn apparatus carried by a monitored person for minimizing emergency response time notwithstanding the conscious state of said monitored person including;

sensing a plurality of vital biometric parameters from said monitored person with said wrist worn apparatus and comparing said sensed vital parameters to a pre-stored standard range of vital parameters for providing a comparator signal;

detecting an abnormal comparator signal not within said pre-stored standard range for providing an emergency alarm signal; and automatically activating a programmable logic controller with said alarm signal for determining the global positioning system location coordinates, locating and establishing a pair of communication links with a medical response team closest to said monitored person, continuously broadcasting medical history data and said vital biometric parameters, time, date, and location of said monitored person directly to said medical response team through either of said communication links and a worldwide communication network for providing emergency medical services.

* * * * *